US009466924B2

(12) United States Patent
Lin et al.

(10) Patent No.: US 9,466,924 B2
(45) Date of Patent: Oct. 11, 2016

(54) ELECTRICAL CONNECTOR WITH A POSITIONING MEMBER

(71) Applicant: LOTES CO., LTD, Keelung (TW)

(72) Inventors: Wen Wei Lin, Keelung (TW); Jin Ba, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 14/987,864

(22) Filed: Jan. 5, 2016

(65) Prior Publication Data

US 2016/0197442 A1 Jul. 7, 2016

(30) Foreign Application Priority Data

Jan. 5, 2015 (CN) ..... 2015 2 0002962 U

(51) Int. Cl.

| | |
|---|---|
| ***H01R 13/6585*** | (2011.01) |
| ***H01R 12/72*** | (2011.01) |
| *H01R 24/60* | (2011.01) |
| *H01R 107/00* | (2006.01) |

(52) U.S. Cl.

CPC ..... *H01R 13/6585* (2013.01); *H01R 12/724* (2013.01); *H01R 24/60* (2013.01); *H01R 2107/00* (2013.01)

(58) Field of Classification Search

USPC ..... 439/607.05, 607.11, 626, 660

See application file for complete search history.

(56) References Cited

U.S. PATENT DOCUMENTS

| | | | | |
|---|---|---|---|---|
| 8,790,138 | B2 * | 7/2014 | Wang | H01R 27/02 439/607.4 |
| 8,851,927 | B2 * | 10/2014 | Hsu | H01R 12/724 439/607.11 |
| 9,106,024 | B2 * | 8/2015 | Zhao | H01R 13/6594 |
| 9,209,573 | B1 * | 12/2015 | Chen | H01R 13/6581 |
| 9,281,643 | B1 * | 3/2016 | Tseng | H01R 13/518 |
| 9,318,856 | B2 * | 4/2016 | MacDougall | H01R 13/6581 |
| 9,343,859 | B2 * | 5/2016 | Choi | H01R 24/62 |
| 9,373,916 | B2 * | 6/2016 | Liu | H01R 13/6581 |
| 2014/0073190 | A1 * | 3/2014 | Zhao | H01R 13/6594 439/626 |
| 2015/0244111 | A1 * | 8/2015 | Ju | H01R 13/6585 439/607.05 |

* cited by examiner

*Primary Examiner* — Alexander Gilman

(74) *Attorney, Agent, or Firm* — Locke Lord LLP; Tim Tingkang Xia, Esq.

(57) ABSTRACT

An electrical connector includes an insulating body having a base and a tongue protruding from the base, a metal casing surrounding the insulating body, multiple terminals grouped into upper and lower rows and fixedly at the insulating body, a shielding sheet disposed at the insulating body and located between the upper and lower rows of terminals, and a positioning member. A positioning slot is disposed at the base. A first buckling portion is disposed inside the positioning slot. Each terminal has a contact portion extending forward and exposed partially from the tongue, and a soldering portion extending backward out of the base. The shielding sheet has a reserved space corresponding to the positioning slot. The positioning member has multiple positioning holes for positioning the soldering portions, and a second buckling portion passing through the reserved space and fixed to the first buckling portion.

19 Claims, 6 Drawing Sheets

100

ELECTRICAL CONNECTOR WITH A POSITIONING MEMBER

CROSS-REFERENCE TO RELATED APPLICATION

This non-provisional application claims priority to and benefit of, under 35 U.S.C. §119(a), Patent Application No. 201520002962.0 filed in P.R. China on Jan. 5, 2015, the entire content of which is hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and more particularly to an electrical connector having a positioning member.

BACKGROUND OF THE INVENTION

Chinese Patent No. CN 201420288762.1 discloses an electrical connector 100. The electrical connector 100 includes an insulating body 1, multiple terminals 2, an outer shielding casing 3, an inner shielding casing 4, a grounding metal plate 5, and a soldering leg positioning member 6. The insulating body 1 is formed of a first insulating member 11 and a second insulating member 12 and has a main body 13 and a tongue 14 protruding forward from the main body 13. The soldering leg positioning member 6 has two engagement blocks 61 respectively protruding from a left side and a right side. A limiting slot 122 is disposed on the second insulating member 12. The two engagement blocks 61 are clasped in the limiting slot 122 on the second insulating member 12, so as to combine and fix the soldering leg positioning member 6 to the main body 13 of the insulating body 1.

However, in the electrical connector 100 having the foregoing structure, the joining of the soldering leg positioning member 6 and the insulating body 1 merely depends on buckling and fixation between the limiting slot 122 below the second insulating member 12 and the engagement blocks 61 that protrude transversely from sidewalls on the left side and the right side of the soldering leg positioning member 6. During assembly, the first insulating member 11 and the second insulating member 12 are first combined to form the insulating body 1, and the soldering leg positioning member 6 is then combined on the insulating body 1. During assembly, when clasping the engagement blocks 61 in the limiting slot 122, because the soldering leg positioning member 6 and the main body 13 have relatively small elastic deformation forces, a relatively strong force is needed to push the engagement blocks 61 into the limiting slot 122, which increases the difficulty of assembling the soldering leg positioning member 6 on the insulating body 1. In addition, because the structure of the engagement blocks 61 are relatively small, buckling strength between the engagement blocks 61 and the limiting slot 122 is relatively weak, and the soldering leg positioning member 6 easily becomes loose and even falls off from the insulating body 1.

Therefore, a heretofore unaddressed need exists in the art to address the aforementioned deficiencies and inadequacies.

SUMMARY OF THE INVENTION

In one aspect, the present invention relates to an electrical connector that has two elastic buckling portions extending from a positioning member and passing through a shielding sheet to be attached to an insulating body, thereby reducing assembly difficulty and increasing buckling stability of the positioning member and the insulating body.

In one embodiment, an electrical connector includes an insulating body, a metal casing surrounding the insulating body, multiple terminals grouped into an upper row and a lower row and fixed at the insulating body, a shielding sheet disposed at the insulating body and located between the upper row of terminals and the lower row of terminals, and a positioning member.

The insulating body has a base and a tongue protruding forward from the base. A positioning slot is disposed at the base. A first buckling portion is disposed inside the positioning slot. Each terminal has a contact portion extending forward and exposed partially from the tongue and a soldering portion extending backward out of the base. The shielding sheet has a reserved space corresponding to the positioning slot. The positioning member has multiple positioning holes and a second buckling portion. The multiple positioning holes are used for positioning the multiple soldering portions. The second buckling portion passes through the reserved space and is attached and fixed to the first buckling portion inside the positioning slot.

In one embodiment, at least one part of the shielding sheet extends into the first buckling portion.

In one embodiment, the reserved space is a through hole.

In one embodiment, there are two second buckling portions, respectively formed by extending upward from two sides of the positioning member.

In one embodiment, the positioning slot passes throughout the base vertically.

In one embodiment, a center of the tongue is lower than an upper surface of a circuit board by 0 mm to 0.62 mm.

In one embodiment, a center of the tongue is higher than an upper surface of a circuit board by 0 mm to 1.48 mm.

In one embodiment, a bending portion is respectively disposed on a left sidewall and a right sidewall of the metal casing to block a front end surface of the base.

In one embodiment, the shielding sheet includes a first shielding portion disposed at the tongue, a second shielding portion disposed at the base, and an inclined portion provided between the first shielding portion and the second shielding portion.

In one embodiment, each terminal further includes a horizontal section and a inclined section. The horizontal section is disposed at the base. The inclined section is located between the contact portion and the horizontal section, and is disposed corresponding to the inclined portion.

In another aspect, the present invention relates to an electrical connector. In one embodiment, an electrical connector includes an insulating body, a metal casing surrounding the insulating body, multiple terminals grouped into an upper row and a lower row and fixed at the insulating body, a shielding sheet disposed at the insulating body and located between the upper row of terminals and the lower row of terminals, and a positioning member.

The insulating body has a base and a tongue protruding forward from the base. A positioning slot is disposed at the base. A first buckling portion is disposed inside the positioning slot. The shielding sheet has a reserved space corresponding to the positioning slot. At least one part of the shielding sheet extends into the first buckling portion. The positioning member has multiple positioning holes and a second buckling portion. The multiple positioning holes are used for positioning the multiple terminals. The second buckling portion passes through the reserved space and is attached to the first buckling portion inside the positioning slot, so that the positioning member is fixed in the insulating body.

In one embodiment, the reserved space is a through hole.

In one embodiment, there are two second buckling portions, respectively formed by extending upward from two sides of the positioning member.

In one embodiment, the positioning slot passes throughout the base vertically.

In one embodiment, a center of the tongue is lower than an upper surface of a circuit board by 0 mm to 0.62 mm.

In one embodiment, a center of the tongue is higher than an upper surface of a circuit board by 0 mm to 1.48 mm.

In one embodiment, a bending portion is respectively disposed on a left sidewall and a right sidewall of the metal casing to block a front end surface of the base.

In one embodiment, the shielding sheet includes a first shielding portion disposed at the tongue, a second shielding portion disposed at the base, and an inclined portion disposed between the first shielding portion and the second shielding portion.

In one embodiment, each terminal includes a horizontal section and a inclined section. The horizontal section is disposed at the base. The inclined section is located between a contact portion of the terminal and the horizontal section, and is disposed corresponding to the inclined portion.

Compared with the related art, certain embodiments of the present invention has the following beneficial advantages. Two second buckling portions extending upward are disposed at the positioning member, so that when the two second buckling portions and the first buckling portion are fastened, an elastic deformation force exists inside the positioning slot, thereby reducing a force needed to assemble the positioning member at the insulating body. In addition, the shielding sheet has a reserved space for the second buckling portion to pass through, and the shielding sheet partially extends into the first buckling portion, so as to increase the strength of the first buckling portion, thereby preventing the first buckling portion from fractures or damage when the first buckling portion and the second buckling portion are attached.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
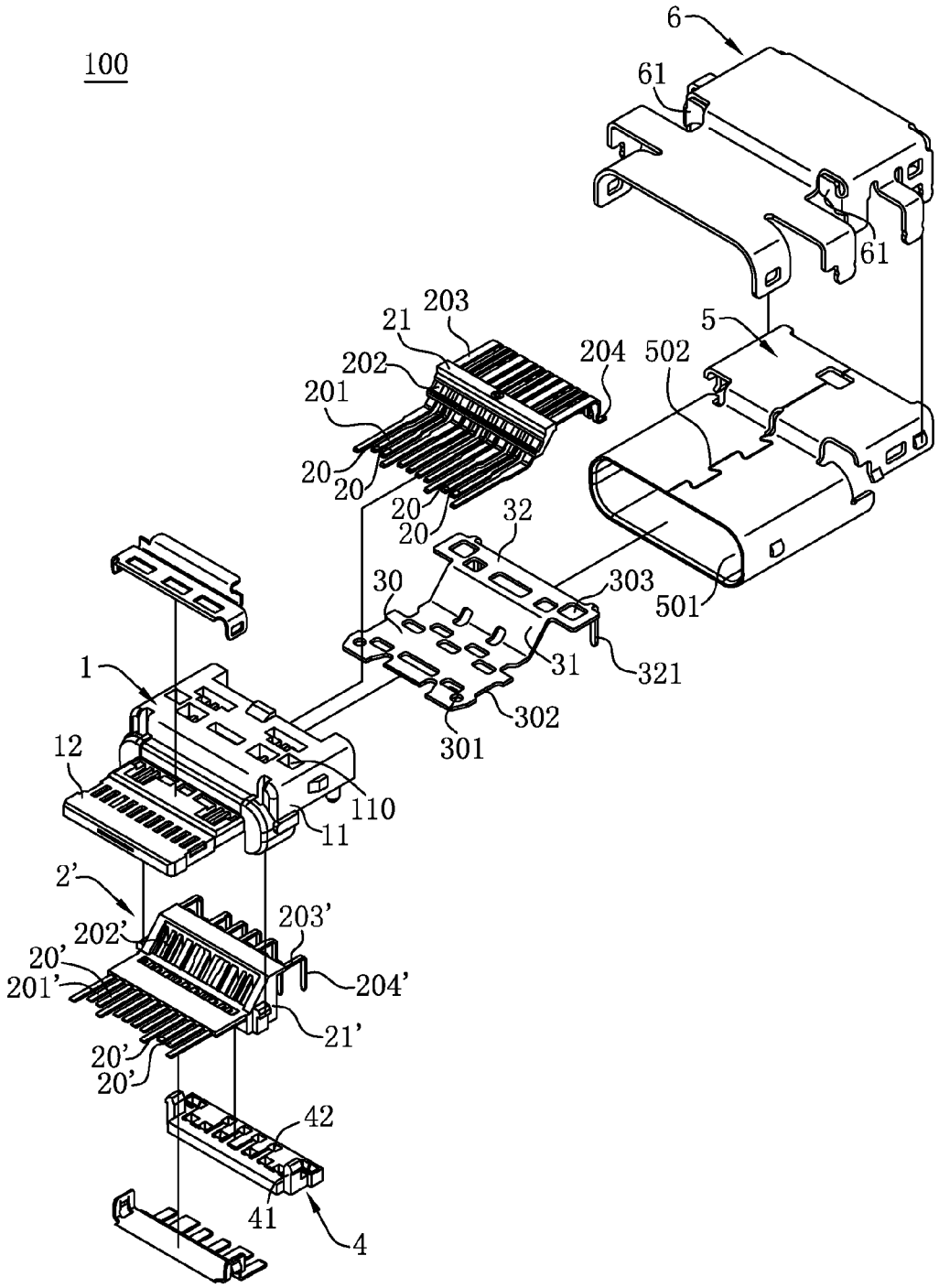
FIG. 1 is a schematic three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-6. In accordance with the purposes of this invention, as embodied and broadly described herein, this invention, in one aspect, relates to an electrical connector.

Figure 3:
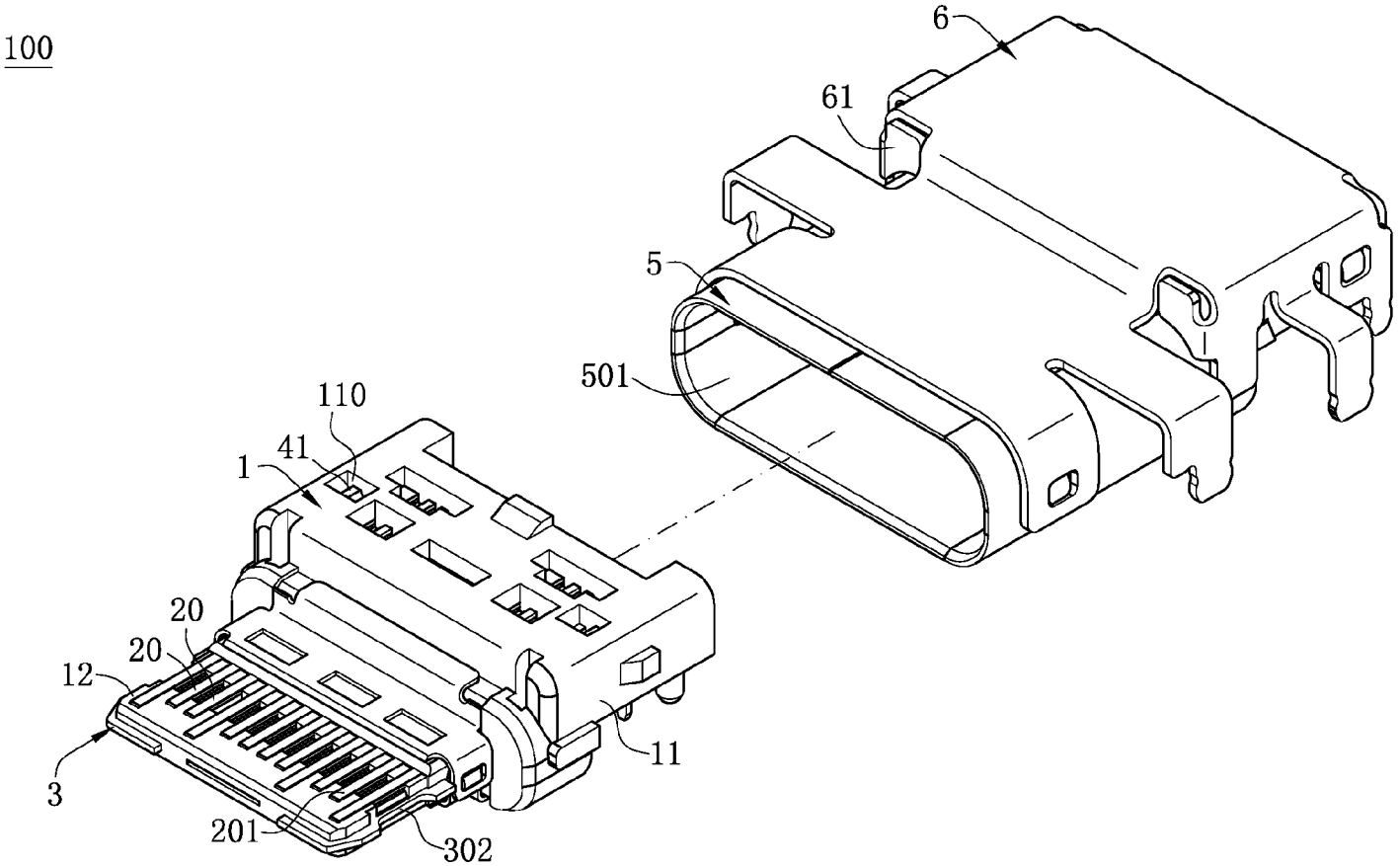
FIG. 3 is a schematic three-dimensional partial exploded view of the electrical connector according to one embodiment of the present invention.
Figure 5:
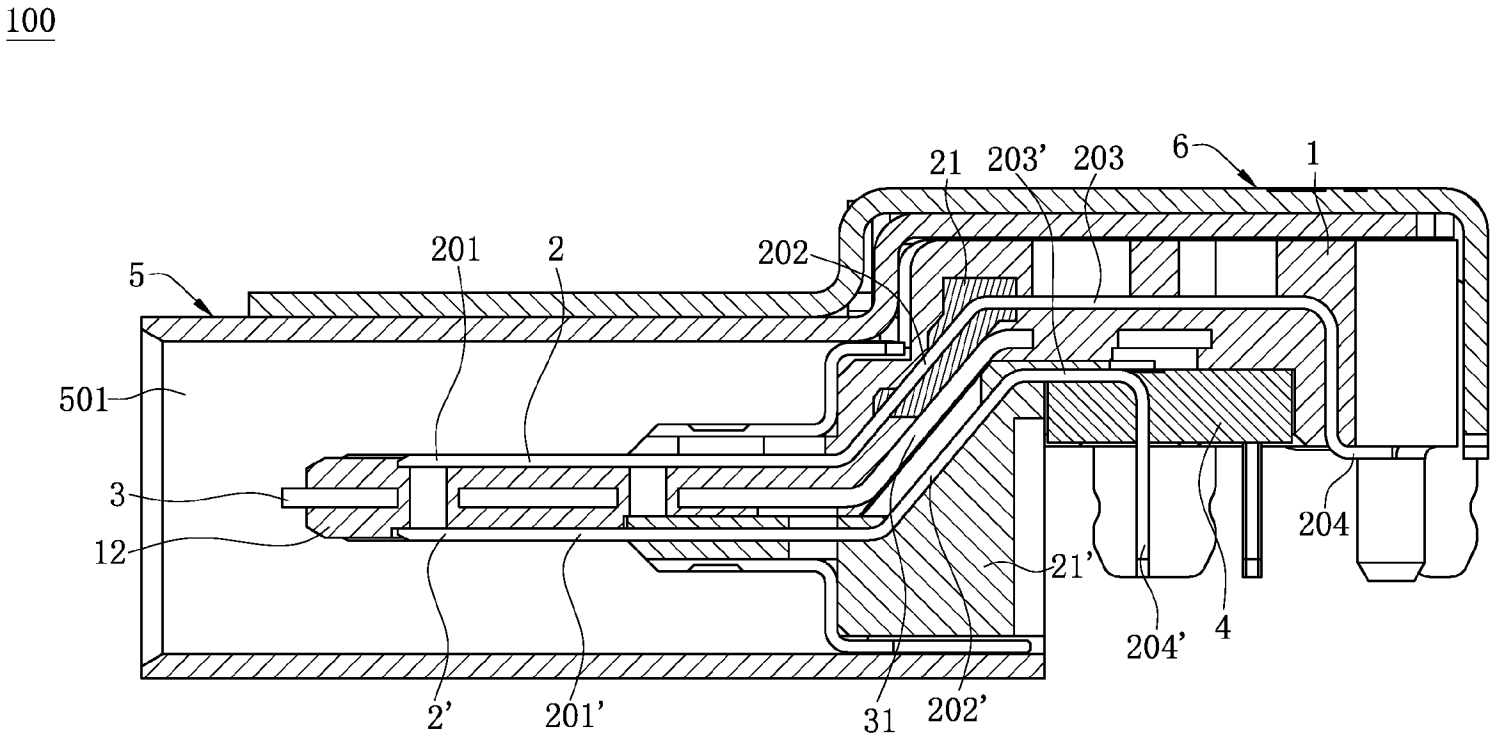
FIG. 5 is a schematic sectional view along a line A-A of the electrical connector in FIG. 4.

As shown in FIGS. 1, 3, and 5, an electrical connector 100 according to one embodiment of the present invention is used for being connected to a circuit board (not shown). The electrical connector 100 includes an insulating body 1, an upper row of terminals 2 and a lower row of terminals 2', a shielding sheet 3, a positioning member 4, a first metal casing 5, and a second metal casing 6. The upper row of terminals 2 and the lower row of terminals 2' are disposed at the insulating body 1. The shielding sheet 3 is disposed at the insulating body 1 and located between the upper row of terminals 2 and the lower row of terminals 2'. The positioning member 4 is disposed at the insulating body 1 and used for positioning the lower row of terminals 2'. The first metal casing 5 surrounds the insulating body 1 to form an insertion space 501. The second metal casing 6 is disposed above the first metal casing 5.

The insulating body 1 has a base 11 and a tongue 12 protruding forward from the base 11. Each of the upper row of terminals 2 and each of the lower row of terminals 2' respectively have contact portions 201, 201' and soldering portions 204, 204'. The contact portions 201, 201' extend forward and partially expose from an upper surface and a lower surface of the tongue 12. The soldering portions 204, 204' extend backward from the base 11 and out of the base 11. The soldering portion 204 of each of the upper row of terminals 2 is soldered on the circuit board by using a surface-mount technology (SMT). The soldering portions 204' of the lower row of terminals 2' are arranged into a front row and a rear row in an insertion direction of a mating connector (not shown) to be soldered on the circuit board by using a dual in-line package (DIP). The contact portions 201, 201' of the upper row of terminals 2 and the lower row of terminals 2' are disposed in a stacked manner in a thickness direction of the tongue 12.

The upper row of terminals 2 and the lower row of terminals 2' respectively include multiple pairs of differential signal terminals 20, 20', so as to improve signal transmission quality of the electrical connector 100. In addition, the upper row of terminals 2 and the lower row of terminals 2' respectively have horizontal sections 203, 203' and inclined sections 202, 202'. The horizontal sections 203, 203' are disposed at the base 11, and the inclined sections 202, 202' are located between the contact portions 201, 201' and the horizontal sections 203, 203'. Compared with a similar type of product, a length of each of the terminals is effectively reduced, thereby improving signal transmission quality of the electrical connector 100. Further, a center of the tongue 12 is lower than an upper surface of the circuit board by 0 mm to 0.62 mm or is higher than an upper surface of the circuit board by 0 mm to 1.48 mm, so that the electrical connector 100 partially sinks in the circuit board, thereby reducing an overall height of a product. In one embodiment, the center of the tongue 12 is lower than the upper surface of the circuit board by 0.32 mm, so as to not only ensure a signal transmission rate of the electrical connector 100, but also effectively reduce a space occupied by the electrical connector 100 in the product, thereby reducing an overall volume of the product and facilitates miniaturization of the product.

Figure 2:
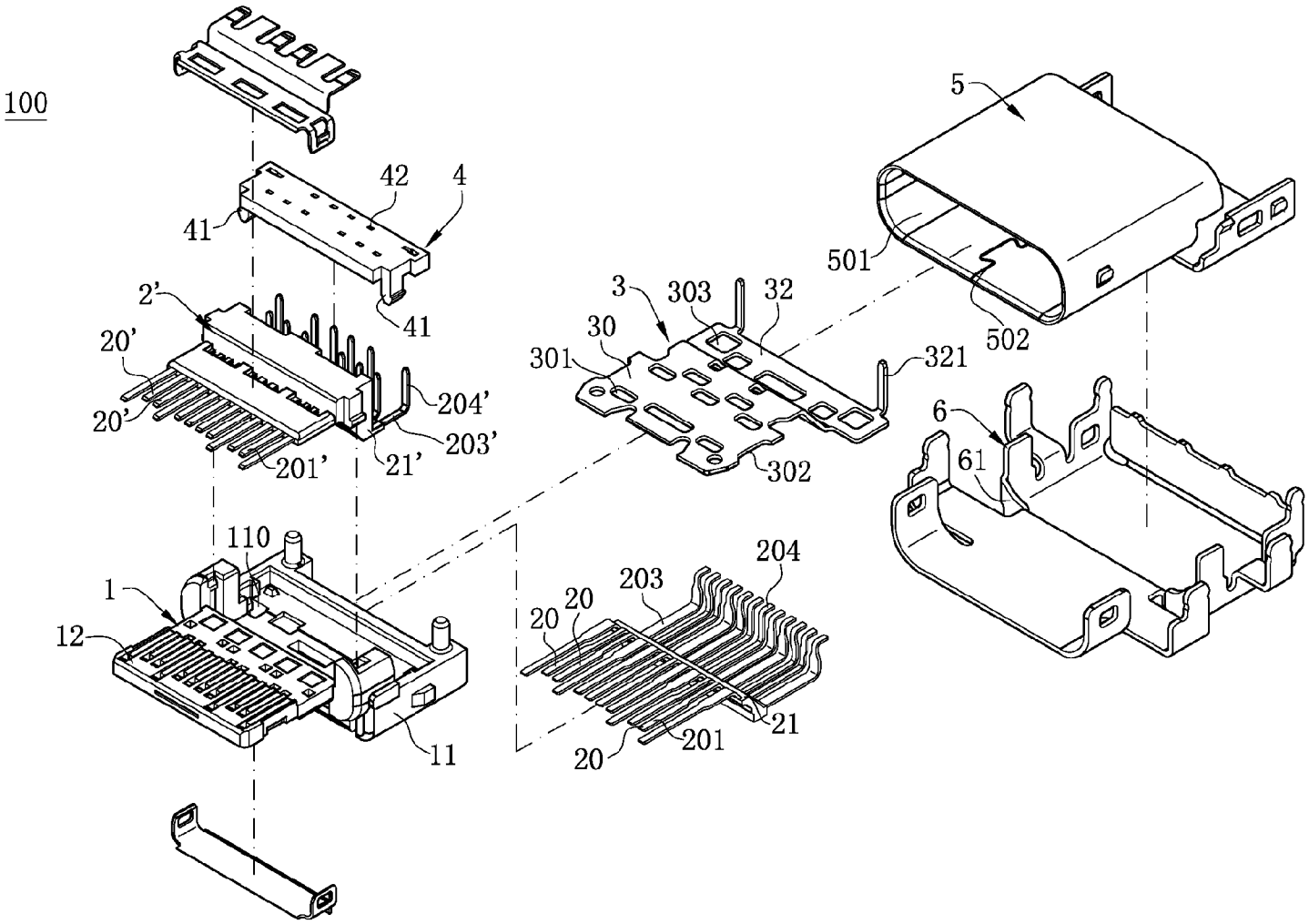
FIG. 2 is a schematic three-dimensional exploded view from another angle of the electrical connector according to one embodiment of the present invention.
Figure 4:
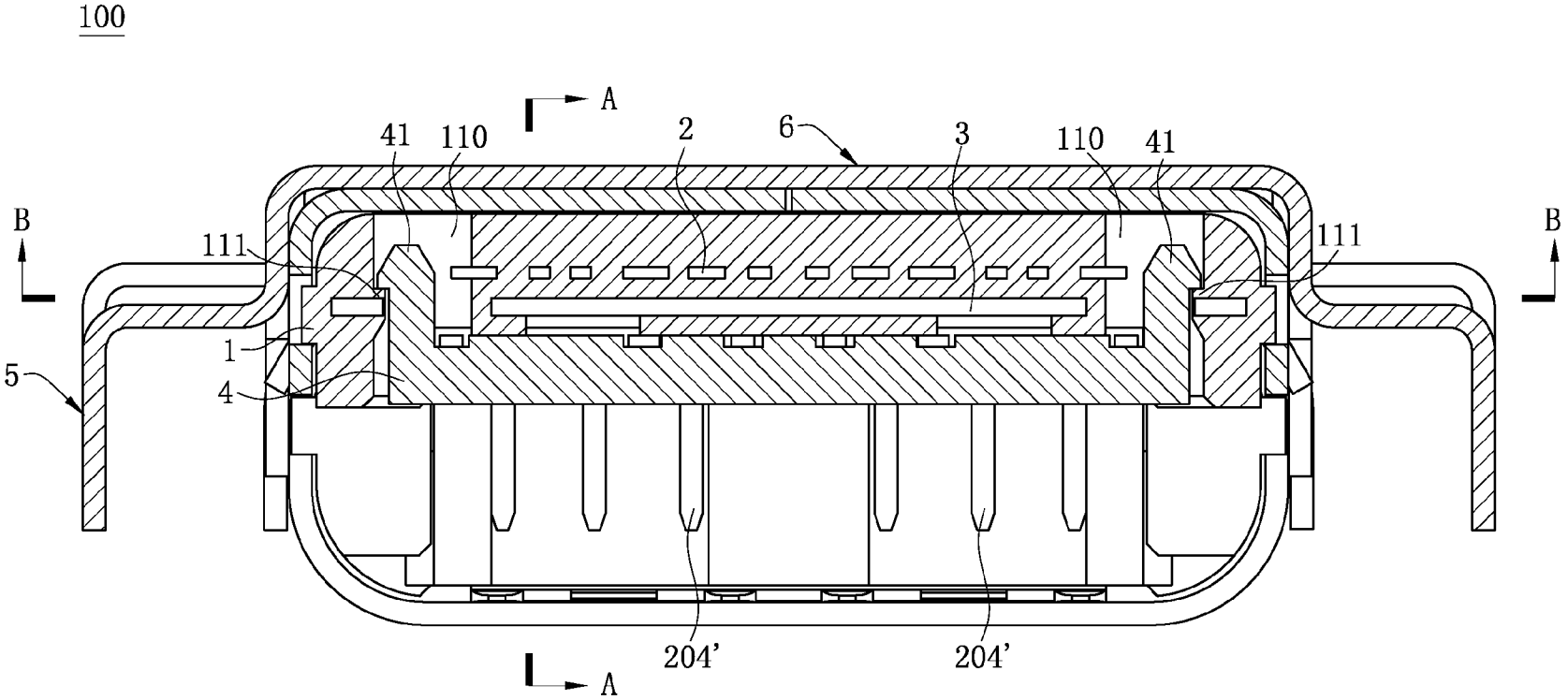
FIG. 4 is a schematic three-dimensional sectional view of the electrical connector according to one embodiment of the present invention.

As shown in FIGS. 1, 2, and 4, positioning holes 42 arranged along a longitudinal direction are disposed on the positioning member 4 for insertion and positioning of the soldering portions 204' of the lower row of terminals 2'. Two second buckling portions 41 extend upward on two sides of a front end of the positioning member 4, so that the positioning member 4 has a "U"-shaped structure as seen from along a longitudinal direction, and each second buckling portion 41 has an elastic deformation force. A positioning slot 110 is respectively disposed on a left side and a right side of the base 11. A first buckling portion 111 is disposed inside each of the positioning slots 110. Each of the second buckling portions 41 is received inside a corresponding one of the positioning slots 110 and is attached and fixed to corresponding one of the first buckling portions 111, so that the positioning member 4 is fixed at the insulating body 1. The positioning slots 110 passes throughout the base 11 vertically, which makes it convenient to observe a state of fixation of the first buckling portions 111 and the second buckling portions 41 inside the positioning slots 110.

Figure 6:
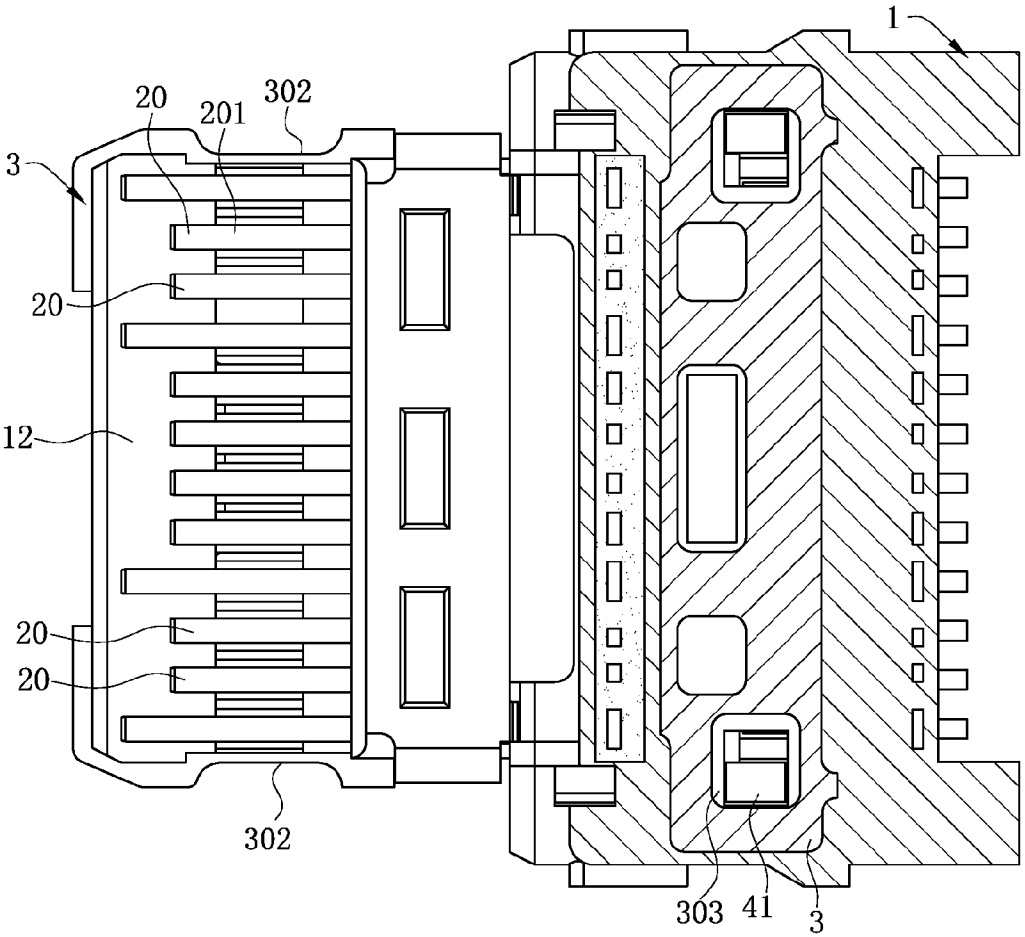
FIG. 6 is a schematic sectional view along a line B-B of the electrical connector in FIG. 4.

As shown in FIGS. 1, 4, and 6, the shielding sheet 3 has a first shielding portion 30 and a second shielding portion 32. The first shielding portion 30 is disposed at the tongue 12 and is located between the contact portions 201 of the upper row of terminals 2 and the contact portions 201' of the lower row of terminals 2', which not only increasing the strength of the tongue 12, but also achieving shielding against signal interference between the upper row of terminals 2 and the lower row of terminals 2'. The second shielding portion 32 is disposed at the base 11. The second shielding portion 32 has a reserved space 303 at a position corresponding to each positioning slot 110, for the corresponding second buckling portion 41 to pass through. In this embodiment, each of the reserved spaces 303 is a through hole, but is not limited thereto. In addition, at least one part of the shielding sheet 3 extends into the first buckling portions 111, so as to increase the strength of the first buckling portions 111, thereby preventing the first buckling portions 111 from fractures or damage when the first buckling portions 111 and the second buckling portions 41 are correspondingly attached. When the positioning member 4 is assembled at the insulating body 1, each of the second buckling portions 41 passes through corresponding one of the reserved spaces 303 and is attached and fixed to corresponding one of the first buckling portions 111 inside corresponding one of the positioning slots 110.

As shown in FIGS. 1, 3, and 5, the first shielding portion 30 extends forward to exceed a front end surface of the tongue 12 and has a buckling slot 302 protruding from a side surface of the tongue 12, so as to reduce a degree of wear of the tongue 12 in a process of inserting and pulling out, so as to further protect the tongue 12. The buckling slot 302 is used for buckling the mating connector. Further, the first shielding portion 30 has multiple holes 301 that are disposed corresponding to the differential signal terminals 20, 20', so that impedance of the differential signal terminals 20, 20' can be effectively improved, thereby improving overall transmission efficiency of the electrical connector 100. In addition, an inclined portion 31 is disposed at a position, corresponding to the inclined sections 202, 202', of the shielding sheet 3 to connect the first shielding portion 30 and the second shielding portion 32. Two sides of a rear end of the second shielding portion 32 bend downward to form two soldering legs 321, and the two soldering legs 321 and the soldering portions 204' of the lower row of terminals 2' are arranged in parallel and inserted in the positioning holes 42 of the positioning member 4.

As shown in FIGS. 1-3, the first metal casing 5 surrounds the tongue 12 to form the insertion space 501. An upper wall of the first metal casing 5 has a seam 502. The second metal casing 6 is fixedly disposed above the first metal casing 5 to cover the seam 502, so that high-frequency noise cannot leak easily, thereby improving an electromagnetic interference (EMI) characteristic of the electrical connector 100. In addition, a bending portion 61 is respectively disposed on a left sidewall and a right sidewall of the second metal casing 6 to block a front end surface of the base 11, so that an inner structure of the electrical connector 100 is isolated from an external environment, thereby further improving the EMI characteristic of the electrical connector 100.

During a forming process, the upper row of terminals 2 is first insert-molded at a plastic block 21 for positioning. The upper row of terminals 2, the shielding sheet 3, and the insulating body 1 are then insert-molded to form a first module (not labeled). The lower row of terminals 2' and an insulating body are separately insert-molded to form a second module (not labeled). During assembly, the second module and the first module are first combined, and the positioning member 4 is then assembled at a rear end of the insulating body 1 to position the soldering portion 204' of the lower row of terminals 2' and the soldering leg 321 of the shielding sheet 3. During assembly of the positioning member 4, the second buckling portions 41 pass through the reserved spaces 303 and is attached to the first buckling portions 111 inside the positioning slots 110, so that the positioning member 4 is fixed at the insulating body 1.

In conclusion, the electrical connector 100 according to certain embodiments of the present invention, among other things, has the following beneficial advantages.

(1) Two second buckling portions 41 extending upward are disposed at the positioning member 4, so that when the two second buckling portions 41 and the first buckling portions 111 are fastened, an elastic deformation force exists inside the positioning slots 110, thereby reducing a force needed to assemble the positioning member 4 at the insulating body 1. In addition, the shielding sheet 3 has the reserved spaces 303 for the second buckling portions 41 to pass through, and at least one part of the shielding sheet 3 extends into the first buckling portions 111, so as to increase the strength of the first buckling portions 111, thereby preventing the first buckling portions 111 from fractures or damage when the first buckling portions 111 and the second buckling portion 41 are attached.

(2) The upper row of terminals 2 and the lower row of terminals 2' respectively have the horizontal sections 203, 203' and the inclined sections 202, 202'. The horizontal sections 203, 203' are disposed at the base 11. The inclined sections 202, 202' are located between the contact portions 201, 201' and the horizontal sections 203, 203'. Compared with a similar type of product, a length of a terminal is effectively reduced, thereby improving signal transmission quality of the electrical connector 100.

(3) The second metal casing 6 is fixedly disposed above the first metal casing 5 to cover the seam 502, so that high-frequency noise cannot leak easily, thereby improving an electromagnetic interference (EMI) characteristic of the electrical connector 100. In addition, the bending portion 61 is respectively disposed on the left sidewall and the right sidewall of the second metal casing 6 to block the front end surface of the base 11, so that an inner structure of the electrical connector 100 is isolated from an external environment, thereby further improving the EMI characteristic of the electrical connector 100.

(4) The first shielding portion 30 extends forward to exceed the front end surface of the tongue 12 and has the buckling slots 302 protruding from the side surfaces of the tongue 12, so as to reduce a degree of wear of the tongue 12 in a process of inserting and pulling out, so as to further protect the tongue 12. The buckling slots 302 are used for buckling the mating connector. Further, the first shielding portion 30 has the multiple holes 301 that are disposed corresponding to the differential signal terminals 20, 20', so that impedance of the differential signal terminals 20, 20' can be effectively improved, thereby improving overall transmission efficiency of the electrical connector 100.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body having a base and a tongue protruding forward from the base, wherein a positioning slot is disposed at the base, and a first buckling portion is disposed inside the positioning slot;

a metal casing, surrounding the insulating body;

a plurality of terminals, grouped into an upper row and a lower row and fixed at the insulating body, wherein each of the terminals has a contact portion extending forward and exposed partially from the tongue and a soldering portion extending backward out of the base;

a shielding sheet, disposed at the insulating body, and located between the upper row of terminals and the lower row of terminals, wherein the shielding sheet has a reserved space corresponding to the positioning slot; and a positioning member, having a plurality of positioning holes and a second buckling portion, wherein the positioning holes are used for positioning the soldering portions, and the second buckling portion passes through the reserved space and is attached and fixed to the first buckling portion inside the positioning slot.

2. The electrical connector according to claim 1, wherein at least one part of the shielding sheet extends into the first buckling portion.

3. The electrical connector according to claim 1, wherein the reserved space is a through hole.

4. The electrical connector according to claim 1, wherein there are two second buckling portions, respectively formed by extending upward from two sides of the positioning member.

5. The electrical connector according to claim 1, wherein the positioning slot passes throughout the base vertically.

6. The electrical connector according to claim 1, wherein a center of the tongue is lower than an upper surface of a circuit board by 0 mm to 0.62 mm.

7. The electrical connector according to claim 1, wherein a center of the tongue is higher than an upper surface of a circuit board by 0 mm to 1.48 mm.

8. The electrical connector according to claim 1, wherein a bending portion is respectively disposed on a left sidewall and a right sidewall of the metal casing to block a front end surface of the base.

9. The electrical connector according to claim 1, wherein the shielding sheet comprises a first shielding portion disposed at the tongue, a second shielding portion disposed at the base, and an inclined portion disposed between the first shielding portion and the second shielding portion.

10. The electrical connector according to claim 9, wherein each of the terminals further comprises:

a horizontal section disposed at the base; and an inclined section, located between the contact portion and the horizontal section, and disposed corresponding to the inclined portion.

11. An electrical connector, comprising:

an insulating body having a base and a tongue protruding forward from the base, wherein a positioning slot is disposed at the base, and a first buckling portion is disposed inside the positioning slot;

a metal casing, surrounding the insulating body;

a plurality of terminals, grouped into an upper row and a lower row and fixed at the insulating body;

a shielding sheet, disposed at the insulating body and located between the upper row of terminals and the lower row of terminals, wherein the shielding sheet has a reserved space corresponding to the positioning slot, and at least one part of the shielding sheet extends into the first buckling portion; and a positioning member, having a plurality of positioning holes and a second buckling portion, wherein the positioning holes are used for positioning the terminals, and the second buckling portion passes through the reserved space and is attached to the first buckling portion inside the positioning slot, so that the positioning member is fixed in the insulating body.

12. The electrical connector according to claim 11, wherein the reserved space is a through hole.

13. The electrical connector according to claim 11, wherein there are two second buckling portions, respectively extending upward from two sides of the positioning member and being formed.

14. The electrical connector according to claim 11, wherein the positioning slot passes throughout the base vertically.

15. The electrical connector according to claim 11, wherein a center of the tongue is lower than an upper surface of a circuit board by 0 mm to 0.62 mm.

16. The electrical connector according to claim 11, wherein a center of the tongue is higher than an upper surface of a circuit board by 0 mm to 1.48 mm.

17. The electrical connector according to claim 11, wherein a bending portion is respectively disposed on a left sidewall and a right sidewall of the metal casing to block a front end surface of the base.

18. The electrical connector according to claim 11, wherein the shielding sheet comprises a first shielding portion disposed at the tongue, a second shielding portion disposed at the base, and an inclined portion disposed between the first shielding portion and the second shielding portion.

19. The electrical connector according to claim 18, wherein each of the terminals comprises:

a horizontal section disposed at the base; and an inclined section, located between a contact portion of the terminal and the horizontal section, and disposed corresponding to the inclined portion.

* * * * *